US009213278B2

(12) United States Patent
Namiki

(10) Patent No.: US 9,213,278 B2
(45) Date of Patent: Dec. 15, 2015

(54) IMAGE FORMING APPARATUS

(71) Applicant: CANON KABUSHIKI KAISHA, Tokyo (JP)

(72) Inventor: Teruhiko Namiki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 13/904,144

(22) Filed: May 29, 2013

(65) Prior Publication Data

US 2013/0322907 A1 Dec. 5, 2013

(30) Foreign Application Priority Data

May 31, 2012 (JP) ..... 2012-124837

(51) Int. Cl.
*G03G 15/20* (2006.01)
*G03G 13/20* (2006.01)
*G03G 15/00* (2006.01)

(52) U.S. Cl.
CPC ..... *G03G 15/205* (2013.01); *G03G 13/20* (2013.01); *G03G 15/2078* (2013.01); *G03G 15/657* (2013.01); *G03G 2215/00599* (2013.01); *G03G 2215/00603* (2013.01); *G03G 2215/00945* (2013.01); *G03G 2215/00949* (2013.01)

(58) Field of Classification Search
CPC ..... G03G 15/205; G03G 15/2078; G03G 2215/00949
USPC ..... 399/67–70
See application file for complete search history.

(56) References Cited

U.S. PATENT DOCUMENTS

| | | | | |
|---|---|---|---|---|
| 5,656,187 | A * | 8/1997 | Miyamoto et al. | 219/216 |
| 6,185,389 | B1 * | 2/2001 | Bartley et al. | 399/69 |
| 7,224,918 | B2 * | 5/2007 | Bartley et al. | 399/70 |
| 7,787,791 | B2 * | 8/2010 | Bartley et al. | 399/70 |
| 8,725,020 | B2 * | 5/2014 | Fukuzawa et al. | 399/69 |
| 2012/0148282 | A1 * | 6/2012 | Fukuzawa et al. | 399/69 |
| 2012/0269533 | A1 * | 10/2012 | Wakide et al. | 399/69 |

FOREIGN PATENT DOCUMENTS

| | | | |
|---|---|---|---|
| JP | 3265853 | B | 3/2002 |
| JP | 2009-175679 | A | 8/2009 |
| JP | 2010-128465 | A | 6/2010 |

* cited by examiner

*Primary Examiner* — David Gray
*Assistant Examiner* — Carla Therrien
(74) *Attorney, Agent, or Firm* — Canon USA, Inc., IP Division

(57) ABSTRACT

The image forming apparatus includes an image forming unit, a fixing unit including a heater, a necessary integral power calculation unit configured to calculate a necessary integral power required for the fixing unit to reach a predetermined fixable temperature, a suppliable integral power calculation unit configured to calculate a suppliable integral power capable of being supplied to the heater in a time elapsing until the recording material reaches the fixing unit, a power source condition detection unit configured to detect a power source condition of a power source for supplying power to the heater, and a controller configured to control a timing to start conveyance of the recording material according to the necessary integral power and the suppliable integral power, wherein the suppliable integral power calculation unit calculates the suppliable integral power according to a resistance value of the heater and the power source condition.

19 Claims, 14 Drawing Sheets

IMAGE FORMING APPARATUS

BACKGROUND OF THE INVENTION

1. Field of the Invention

The present invention relates to an electrophotographic image forming apparatus such as a printer or a copying machine.

2. Description of the Related Art

In recent years, there has been a demand for the image forming apparatus to shorten a first print out time (hereinafter, abbreviated as a FPOT), which indicates a time elapsing until the first sheet of a recording material is discharged after receiving a request to form an image. The FPOT largely depends on a time elapsing until a fixing device reaches a fixable temperature after receiving the request to form the image (hereinafter, referred to as a rising time).

Meanwhile, in order to cope with the colorization and speeding-up of an image forming apparatus, an inline-type color image forming apparatus has been developed. In the inline-type image forming apparatus, a plurality of photosensitive drums is mounted. Toner images with different colors are formed on the respective photosensitive drums, sequentially overlaid with each other on an intermediate transfer belt, and then collectively transferred onto a recording material. Alternatively, the toner images on the photosensitive drums are sequentially overlaid on the recording material which is disposed on a transfer belt.

In the case of an inline-type color image forming apparatus, a time elapsing until the recording material reaches the fixing device after starting the formation of the image on a first photosensitive drum is long. Japanese Patent No. 3265853 discusses the apparatus in which, when a time necessary for the fixing device to reach a fixing temperature calculated from a temperature rising rate of a heater is shorter than a time necessary for the recording material to reach the fixing device, the recording material starts to be fed immediately after the temperature rising rate is measured. In contrast, when the time necessary for the fixing device to reach the fixing temperature is longer than the time necessary for the recording material to reach the fixing device, the feeding of the recording material is to be delayed.

In order to shorten the FPOT, it is necessary to supply more power to the fixing device and determine, when the fixing device is at a lower temperature, whether "to start the formation of an image". The apparatus discussed in Japanese Patent No. 3265853 is effective in setting the timing of sheet feeding. However, since the timing of sheet feeding is determined based on temperature change information of the fixing device, there is a limitation in shortening the FPOT.

SUMMARY OF THE INVENTION

The present invention is directed to an image forming apparatus capable of determining a timing of sheet feeding as early as possible.

According to an aspect of the present invention, an image forming apparatus includes an image forming unit configured to form an unfixed toner image on a recording material, a fixing unit configured to heat and fix the unfixed toner image formed onto the recording material, the fixing unit including a heater, a necessary integral power calculation unit configured to calculate a necessary integral power required for the fixing unit to reach a predetermined fixable temperature, a suppliable integral power calculation unit configured to calculate a suppliable integral power capable of being supplied to the heater in a time elapsing until the recording material reaches the fixing unit, a power source condition detection unit configured to detect a power source condition of a power source for supplying power to the heater, and a controller configured to control a timing to start conveyance of the recording material according to the necessary integral power and the suppliable integral power, wherein the suppliable integral power calculation unit calculates the suppliable integral power according to a resistance value of the heater and the power source condition.

Further features of the present invention will become apparent from the following description of exemplary embodiments with reference to the attached drawings.

DESCRIPTION OF THE EMBODIMENTS

Figure 1:
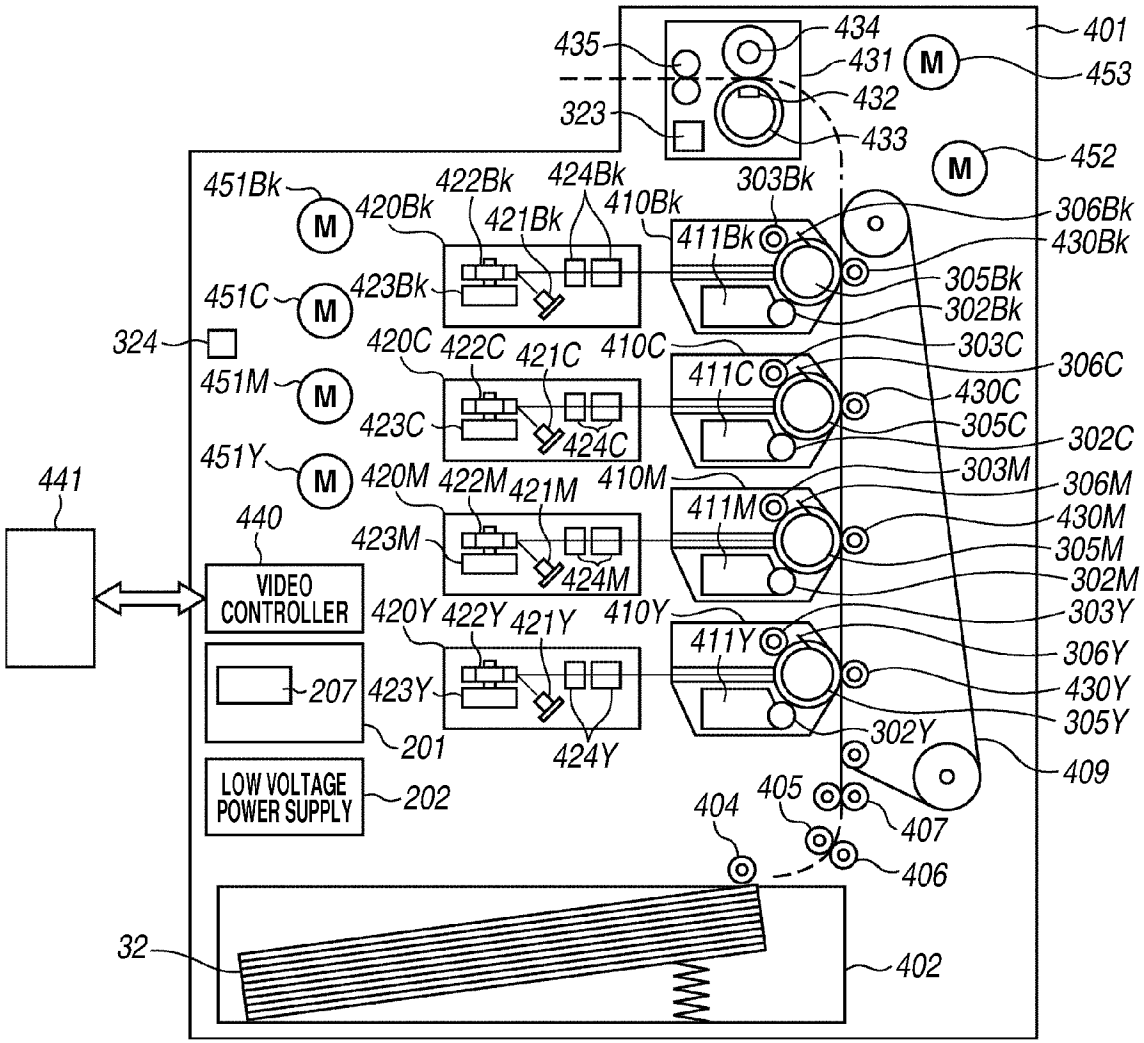
FIG. 1 is a schematic view of an image forming apparatus according to a first exemplary embodiment of the present invention.

Various exemplary embodiments, features, and aspects of the invention will be described in detail below with reference to the drawings.

An image forming apparatus described below is a device which forms a color image using toners of four colors in total, i.e., yellow (Y), magenta (M), cyan (C), and black (Bk).

Components which are common to the four-color toners will be described only using reference numerals, and redundant description will be avoided.

FIG. 1 is a configuration diagram of a color laser printer, which is an image forming apparatus, according to a first exemplary embodiment of the present invention. The color laser printer includes a main body 401, a sheet feeding cassette 402 which accommodates a recording material 32, a pickup roller 404 which picks out the recording material 32 from the sheet feeding cassette 402, and a sheet feeding roller 405 which conveys the recording material 32 picked out by the pickup roller 404. The color laser printer further includes a retard roller 406 which forms a pair with the sheet feeding roller 405 to prevent the double feeding of the recording material 32, and a registration roller pair 407.

An electrostatic adsorption conveyance transfer belt (hereinafter, abbreviated as an ETB) 409 electrostatically adsorbs the recording material 32 to convey the recording material 32. A process cartridge 410 includes a photosensitive drum 305, a charging roller 303 which charges the photosensitive drum 305, a development roller 302 which develops an electrostatic latent image formed on the photosensitive drum 305 using a toner, a toner storage container 411, and a cleaner 306 which removes the toner from the photosensitive drum 305. The cartridge 410 is attachable/detachable to/from the printer main body 401.

A scanner unit 420 includes a laser unit 421 which emits laser light modulated based on an image signal for each color transmitted from a video controller 440, which will be described below. The scanner unit 420 further includes a polygon mirror 422 which scans the photosensitive drum 305 with the laser light emitted from the laser unit 421, a scanner motor 423, and an image forming lens group 424. A transfer roller 430 transfers a toner image from the photosensitive drum 305 onto the recording material on the ETB 409. Further, the process cartridges 410, the scanner units 420, and the transfer rollers 430 are each provided for four colors (yellow Y, magenta M, cyan C, and black Bk). The above-mentioned components constitute an image forming unit which forms an unfixed toner image onto the recording material.

A fixing device (a fixing unit) 431 heats the unfixed toner image, which is formed on the recording material, and fixes the unfixed toner image onto the recording material. The fixing device includes an endless belt (a heating sleeve) 433, a heater 432 which comes into contact with an inner surface of the endless belt 433, and a roller (a pressure roller) 434 which forms a nip portion (a fixing nip portion) which nips and conveys the recording material together with the heater 432 with the endless belt 433 therebetween. Further, a discharge roller pair 435 conveys the recording material 32 which has passed the fixing nip portion, and a storage unit (a memory) 323 stores a resistance value of the heater. The memory 323 is mounted on the fixing device 431 and a resistance value of a heat generator of the heater 432 measured at the time of manufacturing the fixing device 431 is stored in the memory 323. The heater 432 is a resistance heat generating heater in which the heat generator and a protective glass are printed on a ceramic substrate.

DC brushless motor 451 drives the process cartridge 410, the DC brushless motor 452 drives the ETB, and the DC brushless motor 453 drives the fixing device 431.

A printer controller 201 is a control unit of the laser printer 401 and includes a microcomputer 207 and various input/output control circuits (not illustrated).

A low voltage power source circuit 202 steps down a primary AC current after smoothing the primary AC current and supplies power to the DC brushless motors 451, 452, and 453 and the printer controller 201.

A video controller 440 expands, upon receiving image data transmitted from a host computer 441 such as a personal computer, the image data as bitmap data and generates an image signal for forming an image. A temperature detection sensor 324 detects an ambient temperature of the image forming apparatus.

Figure 2:
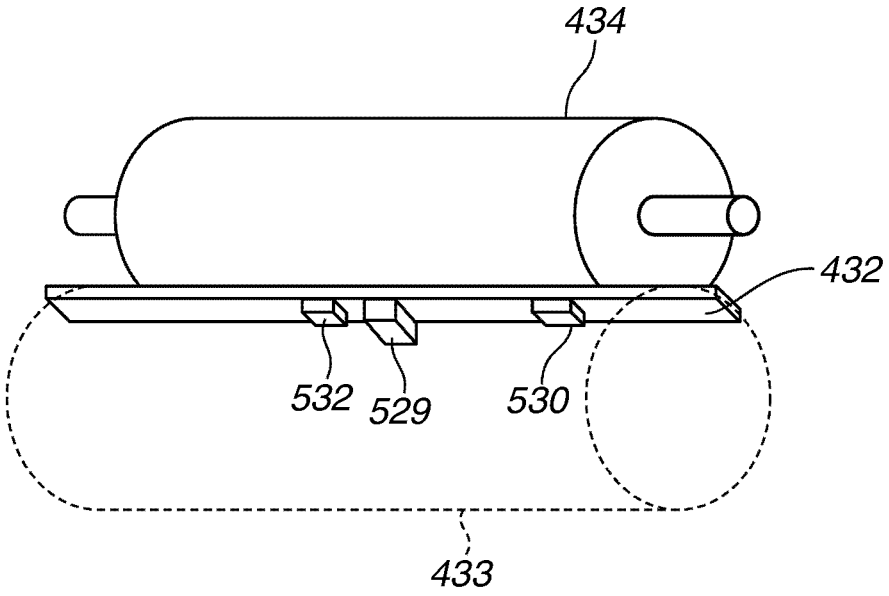
FIG. 2 is a perspective view of a fixing device according to the first exemplary embodiment.
Figure 3:
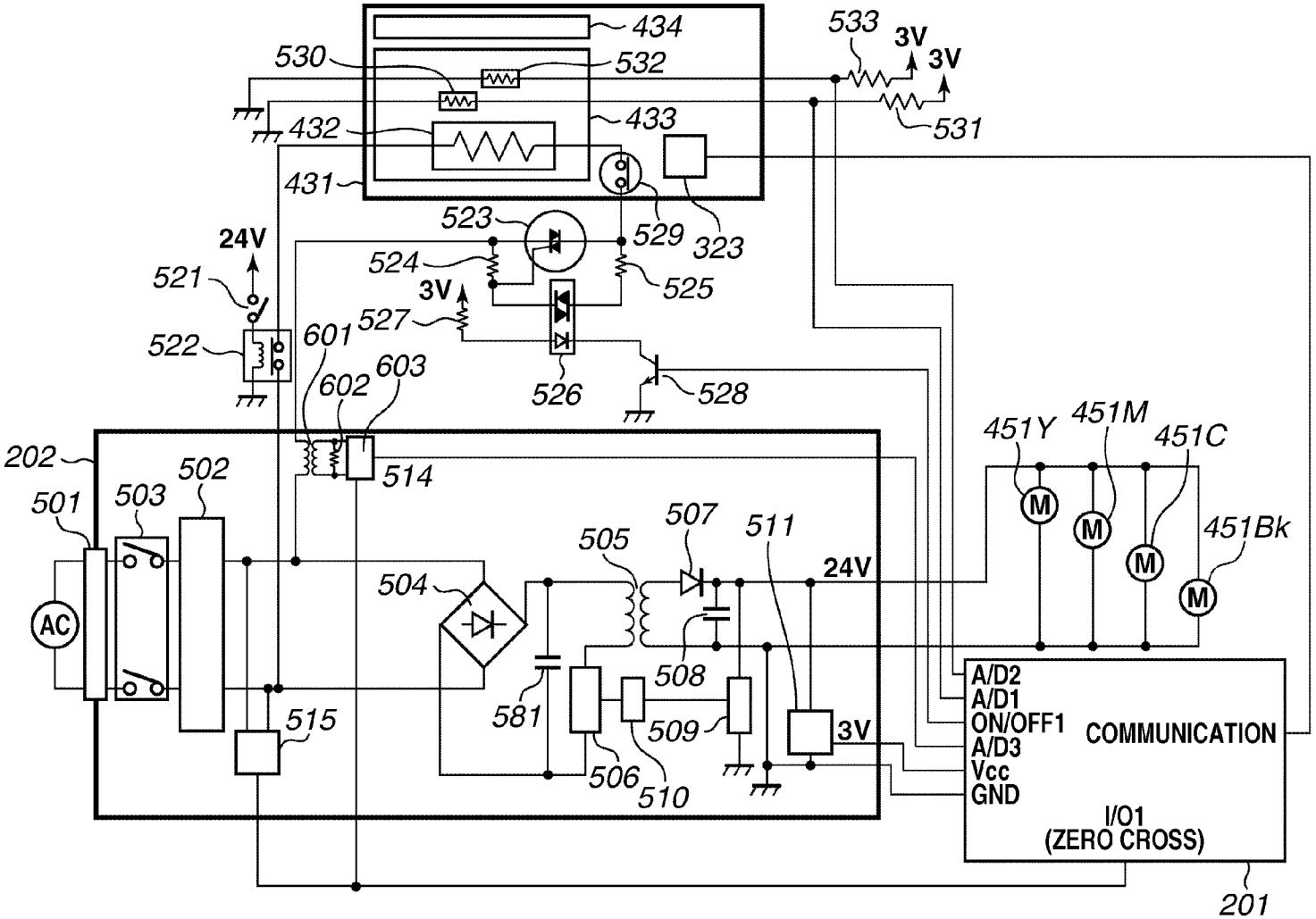
FIG. 3 is a block diagram illustrating details of a low voltage power source and details of a power control circuit of the fixing device according to the first exemplary embodiment.
Figure 4:
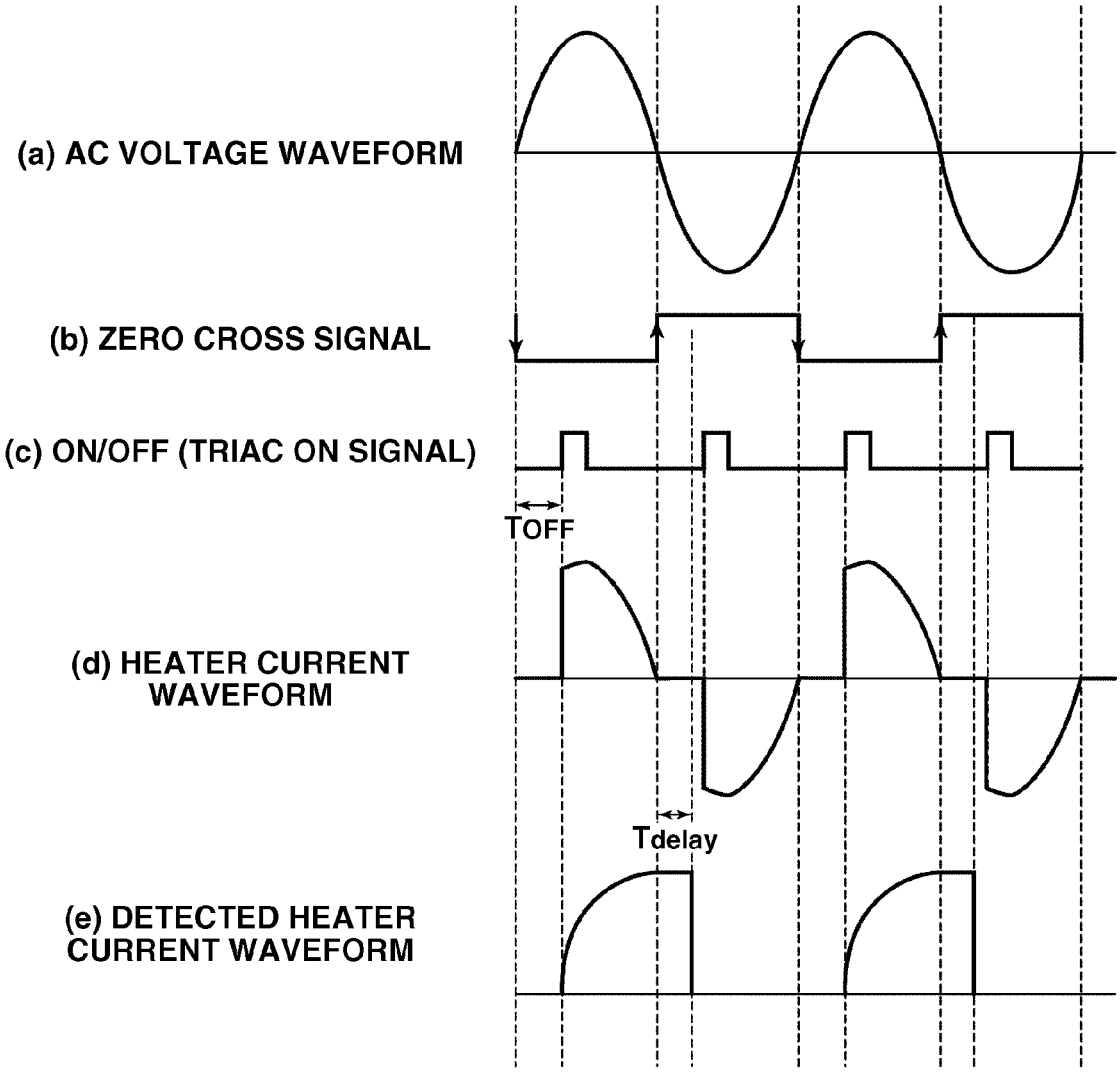
FIG. 4 is a view illustrating a waveform of a heater current which is supplied to a heater of the fixing device according to the first exemplary embodiment.

FIG. 2 is a perspective view of the fixing device 431, FIG. 3 is a block diagram illustrating details of the low voltage power source circuit 202 and details of the power control circuit of the fixing device 431, and FIG. 4 is a view illustrating a waveform of a heater current which flows in the heater of the fixing device 431.

Referring to FIG. 2, the heater 432, the heating sleeve 433, and the pressure roller 434 are illustrated. The heating sleeve 433 according to the exemplary embodiment is a flexible endless belt. A thermoswitch 529 blocks the power from being supplied to the fixing device 431 when the heater 432 exceeds a predetermined temperature, and a thermistor (a sub thermistor) 530 is in contact with an edge of the heater 432 in a longitudinal direction of the heater. A thermistor (a main thermistor) 532 is in contact with a portion near the center of the heater 432 in the longitudinal direction of the heater. The heating sleeve 433 and the heater 432 form a heating unit, and the heating unit and the pressure roller 434 come into contact with each other to form the fixing nip portion which conveys the recording material 32.

Referring to FIG. 3, the low voltage power source circuit 202, an inlet 501, an AC filter 502, a main switch 503, a diode bridge 504, and a converter 505 are illustrated. The AC filter 502 removes a noise from the commercial power source and a noise from the low voltage power source. The converter 505 generates a voltage of 24 V. A converter control circuit 506, a diode 507, a capacitor 508, a constant voltage control circuit 509, a photo coupler 510, and a DC/DC converter 511 are further provided. The DC/DC converter 511 generates a voltage of 3 V from a voltage of 24 V. A current transformer 601 detects a current which flows in the heater 432. In addition, a resistor 602, an effective current detection circuit 603, and a zero cross detection circuit 515 are provided. An interlock switch 521 is opened/closed in association with a door of the image forming apparatus. A relay 522, a triac 523, resistors 524, 525, and 527, a photo triac coupler 526, and a transistor 528 are provided.

Next, a temperature control operation and a heater current detecting operation of the fixing device 431 will be described with reference to FIGS. 3 and 4.

If the main switch 503 is turned on, a commercial current flows via the inlet 501 and the AC filter 502 to be full-wave rectified by the diode bridge 504 and the capacitor 581. The converter 505 is switched by the converter control circuit 506 and a ripple current is excited at a secondary side of the converter 505. The ripple current is rectified by the diode 507 and the capacitor 508.

A rectified voltage is detected by the constant voltage control circuit 509, and the converter control circuit 506 is controlled via the photo coupler 510 so that the rectified voltage becomes constant (24 V in the exemplary embodiment). The rectified voltage of 24 V is supplied to the DC brushless motor 451 and the DC/DC converter 511 to generate a voltage of 3 V. The generated voltage of 3 V is supplied to the printer controller 201 and used to control the image forming apparatus 401.

The printer controller 201 detects the divided voltage of the sub thermistor 530 and the resistor 531 via an A/D port 1. Further, The printer controller 201 detects the divided voltage of the main thermistor 532 and the resistor 533 via an A/D port 2. The thermistor has a characteristic that the resistance value is lowered as the temperature increases, and the printer controller 201 detects a temperature of the heater 432 by the divided voltages of the A/D ports 1 and 2. The commercial power source (power) is supplied to the heater 432 in the fixing device 431 via the relay 522, the triac 523, and the thermoswitch 529 (part (a) in FIG. 4). The printer controller 201 detects a timing when a polarity of the commercial power source is switched, that is, a zero cross via the zero cross detection circuit 515 (part (b) in FIG. 4). In a time $T_{OFF}$ elapsing after detecting the zero cross, a triac ON signal is output from an ON/OFF port 1 and the transistor 528 is turned on (part (c) in FIG. 4). If the transistor 528 is turned on, a current flows in the photo triac coupler 526 via the resistor 527 and the photo triac coupler 526 is turned on. If the photo triac coupler 526 is turned on, a gate current flows in the triac 523 via the resistors 524 and 525, the triac 523 is turned on, and a current flows in the heater 432 to generate heat (part (d) in FIG. 4). The triac 523 is turned off when the gate current is zero, that is, at a next zero cross timing. The printer controller 201 controls the heater current using $T_{OFF}$ to control a calorific value of the heater 432 so that the printer controller 201 can control a temperature at the center of the heater 432, which is detected via the A/D port 2, to be maintained at a control target temperature. In the meantime, a temperature at an and end portion of the heater 432 is monitored via the A/D port 1 f the temperature of the heater 432 reaches an abnormal level, the relay 522 is turned off to perform a protecting operation.

Next, an operation of detecting the heater current which flows in the heater will be described. Part (e) in FIG. 4 illustrates an output waveform of the effective current detection circuit 603. The effective current detection circuit 603 starts, at the falling edge of the zero cross signal, to calculate an effective value of the heater current converted into a voltage by the current transformer 601 and the resistor 602. Upon detecting the rising edge of the zero cross signal, the effective current detection circuit 603 ends the effective value calculation and clears the output after storing a predetermined time (Tdelay) value. The printer controller 201 detects the heater current from a voltage value of an A/D port 3 at a predetermined timing during a time from the detection of the rising edge of the zero cross signal to Tdelay. By repeating the above operations, a heater current per commercial current wave (per half cycle) is detected. In the exemplary embodiment, the current detection circuit 603 serves as the power source condition detection unit which detects a power source condition (power source status) of a power source which supplies power to the heater.

Next, an image forming operation will be described. First, the image data is transmitted from the host computer 441 to the video controller 440. The video controller 440 transmits, to the printer controller 201, a print signal which instructs the printer controller 201 to start the formation of an image and converts the received image data into bitmap data. Upon receiving the print signal, the printer controller 201 supplies power to the fixing device 431 and starts driving the scanner motor 423, the main motor 451, the ETB motor 452, and the motor 453 at a predetermined timing. Further, the printer controller 210 drives the pickup roller 404, the sheet feeding roller 405, and the retard roller 406 to pick out the recording material 32 from the sheet feeding cassette 402. The recording material 32 is conveyed to the registration roller pair 407 and then temporarily suspended. Thereafter, the recording material 32 is re-fed at a timing which will be described below, and conveyed to the ETB 409. In the meantime, the printer controller 201 transmits an image data transmission starting signal (hereinafter, referred to as a TOP signal) to the video controller 440 to match a timing of the re-fed recording material. Upon receiving the TOP signal, the video controller 440 transmits the bitmap data to the printer controller 201. Upon receiving the bitmap data, the printer controller 201 controls the laser unit 421 to be turned on/off according to the bitmap data and forms an electrostatic image on the photosensitive drum 305 charged at a predetermined potential by the charging roller 303 via the polygon mirror 422 and the image forming lens group 424. Thereafter, the electrostatic image is developed into a toner image by the development roller 302 and the toner image on the photosensitive drum 305 is transferred onto the recording material 32 by the transfer roller 430. Such an image forming operation is performed for yellow Y, magenta M, cyan C, and black Bk to form a color toner image on the recording material 32. The recording material 32, on which an unfixed color toner image has been formed, is conveyed to the fixing device 431 and the unfixed toner image is heated and fixed onto the recording material 32 between the heating sleeve 433 heated by the heater and the pressure roller 434. Thereafter, the recording material 32 is discharged by the discharge roller pair 435 to the outside of the image forming apparatus 401.

Next, an operation performed until the recording material 32, which has been temporarily suspended in the registration roller pair (sheet feeding unit) 407, is re-fed according to the instruction from the printer controller 201 will be described in detail with reference to FIGS. 5 to 7.

Figure 5:
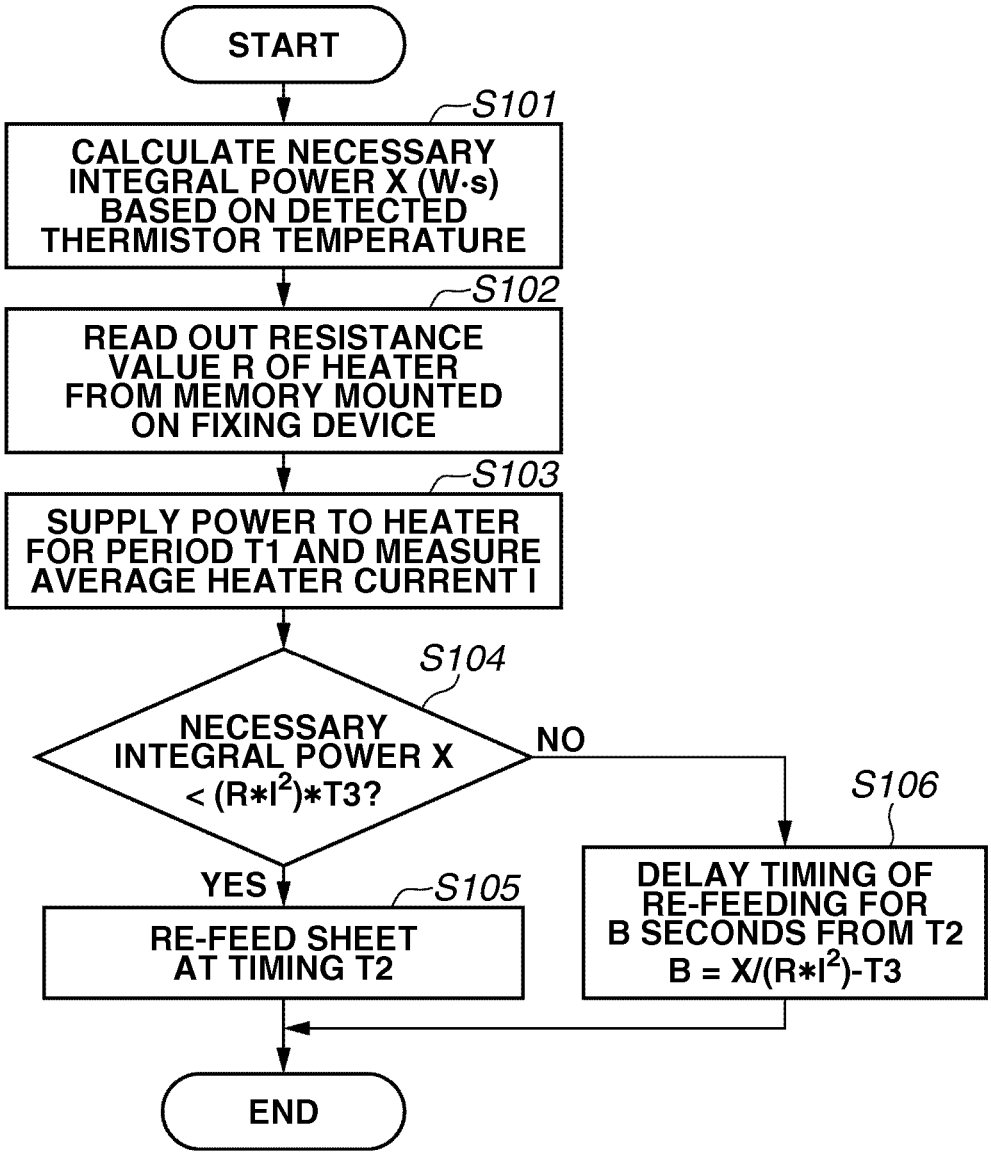
FIG. 5 is a flowchart illustrating an operation of supplying power to the fixing device and a timing of re-feeding according to the first exemplary embodiment.
Figure 6:
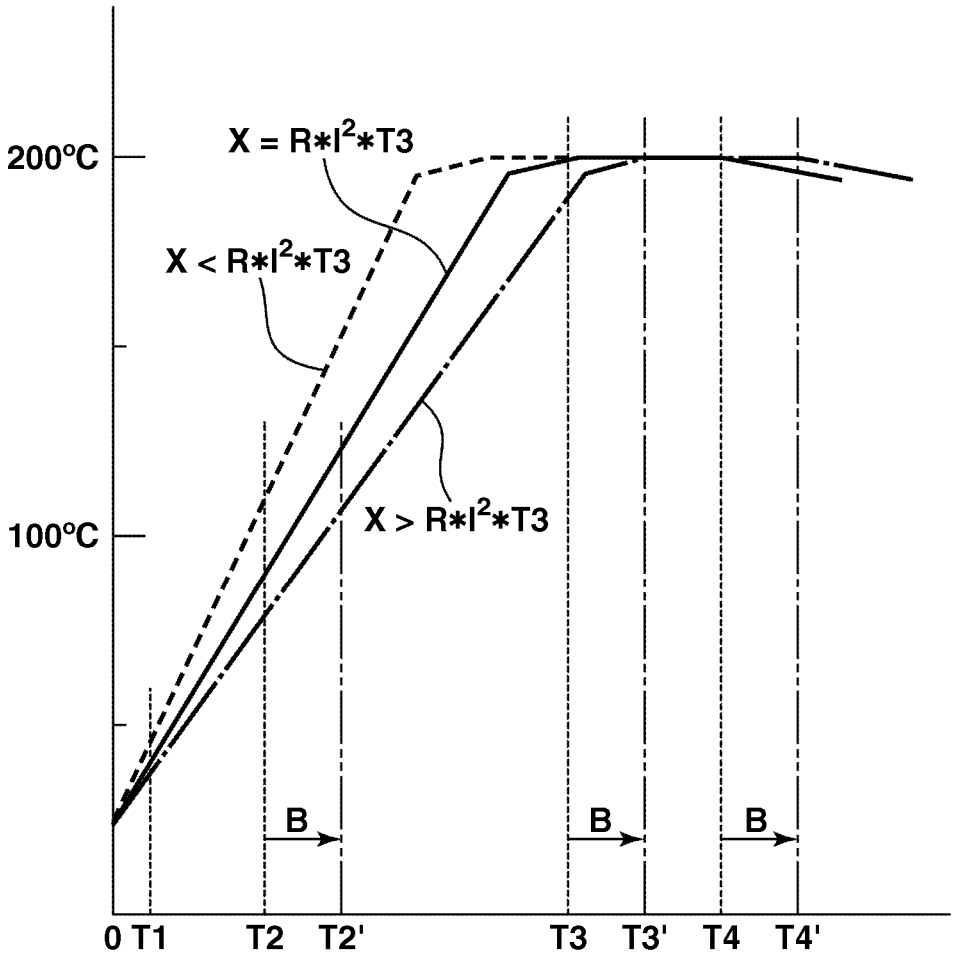
FIG. 6 is a view illustrating a temperature change of a thermistor according to the first exemplary embodiment.

FIG. 5 is a flowchart illustrating an operation of supplying power to the fixing device 431 and the timing of re-feeding, and FIG. 6 is a view illustrating a change in temperature (temperature change of the heater) of the main thermistor 532. FIG. 7 is a table illustrating a necessary integral power which is required for the thermistor 532 to reach 200° C., a control target temperature (a fixing temperature) at the time of fixing, the table being stored in the microcomputer 207 on the printer controller 201. Further, the printer controller 201 has a function as a necessary integral power calculation unit which calculates a necessary integral power required for the fixing unit to reach a predetermined fixable temperature (a control target temperature at the time of fixing in the exemplary embodiment) based on the detection result of the temperature detection unit (thermistor 532). In addition, the printer controller 201 has a function as a suppliable integral power calculation unit which calculates a suppliable integral power that can be supplied to the heater in a time necessary for the recording material to reach from the sheet feeding unit (the registration roller pair in the exemplary embodiment) to the fixing unit, based on the resistance value of the heater and the detection result of the power source condition detection unit.

In FIG. 6, a time 0 to a time T1 is a period during which an average heater current I is detected, a time T2 is a timing when the recording material which has been temporarily suspended in the registration roller pair 407 is re-fed, a time T3 is a timing when the recording material reaches the fixing device 431, a time T4 is a timing when the recording material is discharged from the image forming apparatus, and T2', T3', and T4' are timings respectively delayed from T2, T3, and T4 for B seconds when the timing of re-feeding is delayed for B seconds. The time T2 to the time T3 is a time during which the recording material is conveyed from the registration roller pair 407 to the fixing device 431.

Figure 7:
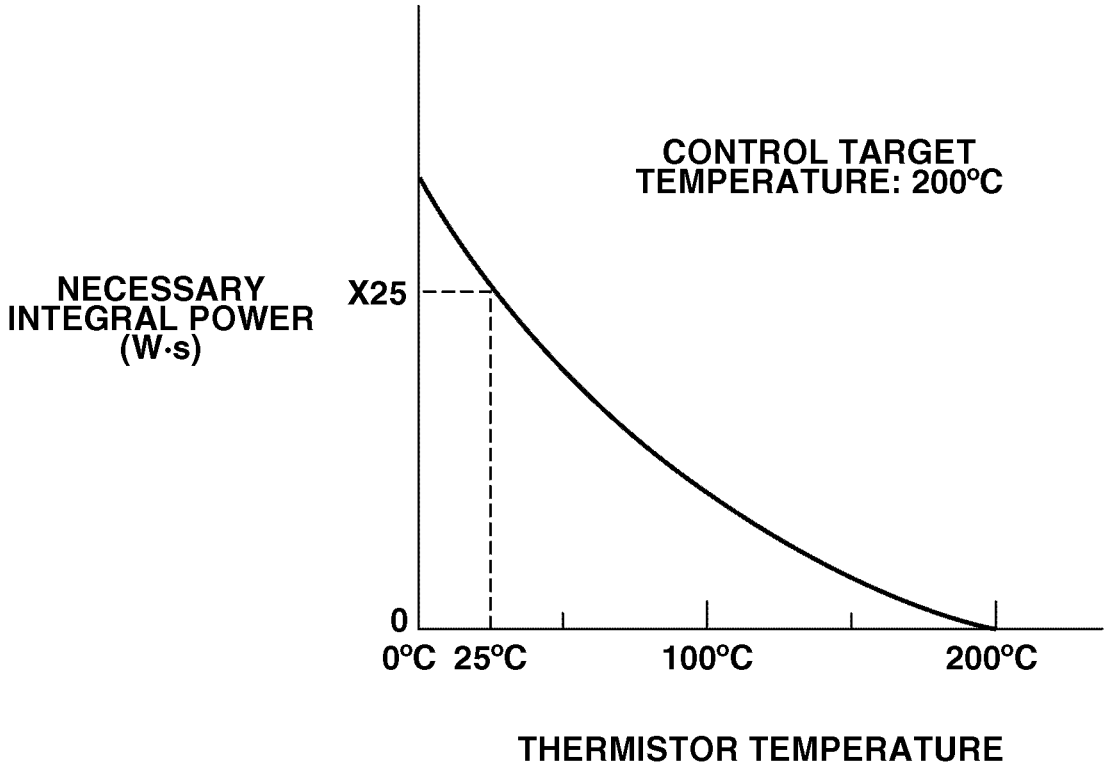
FIG. 7 is a table illustrating a necessary integral power required until the fixing device according to the first exemplary embodiment reaches 200° C.

As illustrated in FIG. 5, when image formation is started, then in step S101, the microcomputer 207 on the printer controller 201 calculates the necessary integral power X required for the fixing device 431 to reach 200° C., which is the fixing temperature, based on a heater temperature (the temperature of the thermistor 532) detected before power is supplied to the heater 432 and the table in FIG. 7 stored in the microcomputer 207. Next, in step S102, a resistance value R of the heater 432 is read out from the memory 323 mounted on the fixing device. Next, in step S103, the heater 432 is supplied with power at a power duty rate ($T_{OFF}$=0) of 100% for a period from the time 0 to the time T1, and an average heater current I is detected for the period. Next, in step S104, equation (1) is calculated to determine whether the heater reaches the fixing temperature of 200° C. by the time T3 when the recording material reaches the fixing device.

$$\text{Necessary integral power } X(W\cdot s) < R*I^2*T3 \quad (1)$$

The right side of equation (1) is the suppliable integral power which can be supplied to the heater for a period from the time 0 to the time T3. In step S105, if the necessary integral power X(W·s) is smaller than the suppliable integral power (YES in step S104), the printer controller 201 re-feeds the recording material from the registration roller pair 407 at a timing of T2 (a predetermined timing) and starts forming an image onto the photosensitive drum 305. The time T2 (timing T2) is a shortest timing to re-feed the recording material 32. In the meantime, if the necessary integral power X(W·s) is larger than the suppliable integral power (NO in step S104), and if the recording material 32 is re-fed at the timing of T2, the toner image is insufficiently fixed since the fixing device 431 (heater) does not reach 200° C. when the recording material reaches the fixing device 431. Therefore, in step S106, equation (2) is calculated to delay the timing of re-feeding for B seconds from T2.

$$\text{Re-feeding delay time } B = X/(R*I^2) - T3 \quad (2)$$

As a result of delaying the timing of re-feeding for B seconds, the heater temperature reaches 200° C. when the recording material 32 reaches the fixing device 431 (time T3' in FIG. 6).

As described above, in the exemplary embodiment, the recording material is fed from the sheet feeding unit at a timing corresponding to the necessary integral power required for the fixing unit to reach a predetermined fixable temperature and the suppliable integral power that can be supplied to the heater in a time necessary for the recording material to reach the fixing unit from the sheet feeding unit. If the suppliable integral power is smaller than the necessary integral power, the timing of sheet feeding is later than the timing of sheet feeding in a case when the suppliable integral power is larger than the necessary integral power.

Further, in the exemplary embodiment, as the necessary integral power X, power required for the heater to reach 200° C., which is the control target temperature at the time of fixing the toner image, is calculated. However, the necessary integral power X does not necessarily need to be power required to reach the control target temperature at the time of fixing, but may be power required to reach a predetermined temperature lower than the control target temperature. In other words, power required for the heater to reach a predetermined fixable temperature may be calculated.

As described above, according to the exemplary embodiment, the timing of sheet feeding is determined without using temperature information such as a temperature rising rate of the fixing device. Therefore, the determining timing can be earlier, and thus the FPOT can be shortened. Specifically, with a condition advantageous to the fixability (for example, when the power source voltage is high or a heater resistance value is low), a fastest FPOT (a time required until time T4) can be shorter. Further, a resistance value of a heat generator of the heater 432 has a large variation in the manufacturing process because it is difficult to adjust the resistance value after printing the heat generator on a heater substrate. In the exemplary embodiment, an actual resistance value, which is stored in the memory, measured when a fixing device is manufactured is used to calculate the delayed timing B of re-feeding so that an optimal timing of re-feeding can be accurately calculated.

In the first exemplary embodiment, an operation performed when the temperature of the fixing device 431 does not reach the predetermined fixable temperature by the time the recording material reaches the fixing device 431, has been described. In a second exemplary embodiment of the present invention, an operation performed when it is determined that the temperature of the fixing device 431 certainly reaches the fixable temperature by the time the recording material reaches the fixing device 431, will be described. Further, a configuration for determining an amount of power supplied to the fixing device 431 from a voltage applied to the fixing device 431 (heater 432) and a heater resistance value will be described.

Figure 8:
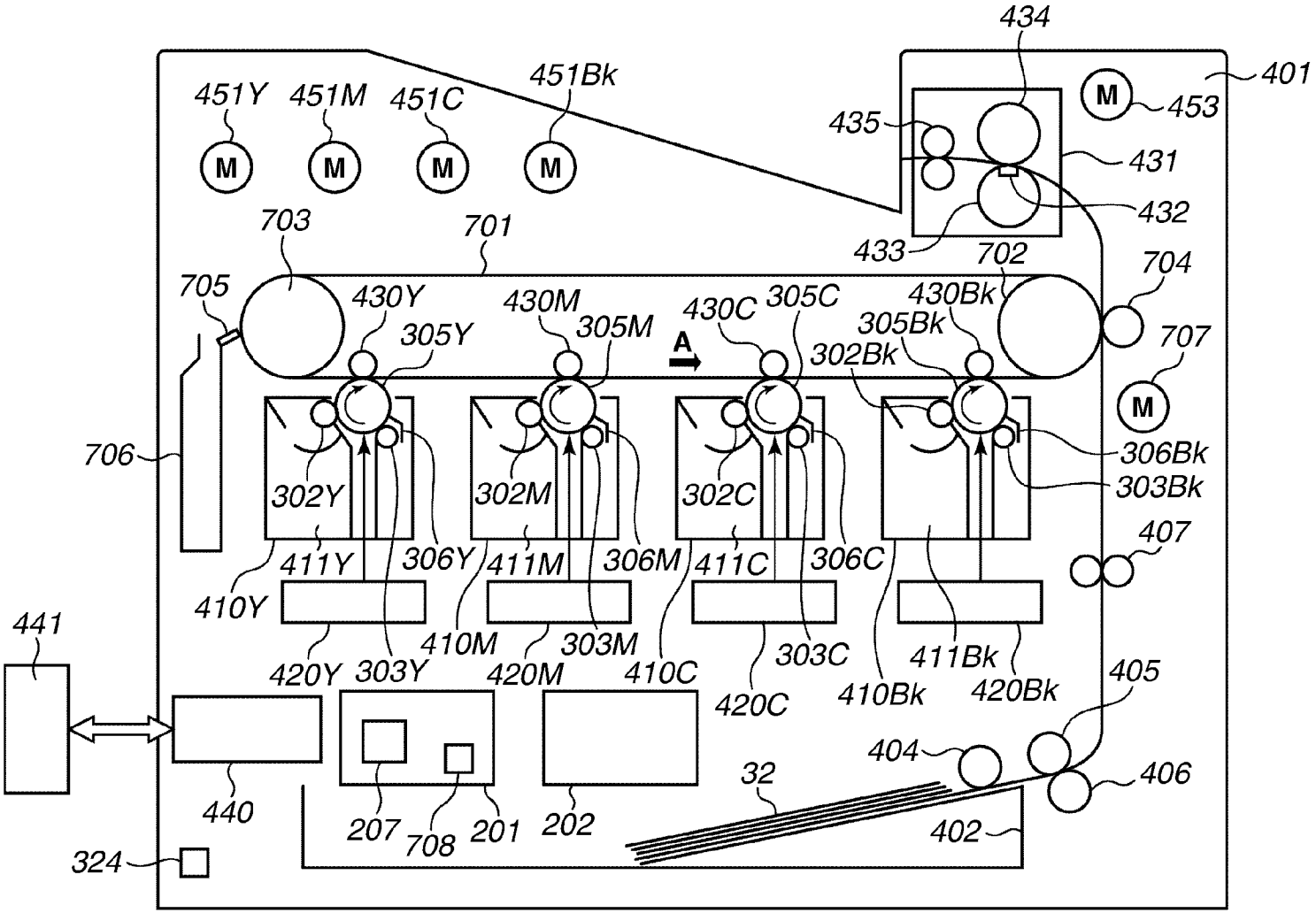
FIG. 8 is a schematic view of an image forming apparatus according to a second exemplary embodiment of the present invention.

FIG. 8 is a configuration view of an intermediate-transfer-belt-type color laser printer, which is an image forming apparatus according to the exemplary embodiment. Components having similar functions to those in FIG. 1 are denoted with the same reference numerals and the description thereof will be omitted.

An intermediate transfer belt 701 (hereinafter, abbreviated as an ITB) primarily transfers a toner image formed on a photosensitive drum 305 and includes a driving roller 702 which drives the ITB 701 and a tension roller 703 which maintains a tension of the ITB. A secondary transfer roller 704 transfers the toner image on the ITB onto a recording material, an ITB cleaning blade 705 removes remaining toner on the ITB, a used toner box 706 reserves the remaining toner which has been removed by the ITB cleaning blade 705, and an ITB driving motor 707 drives the ITB. A memory 708 is mounted on the printer controller 201 and a resistance value of a heat generator of the heater 432 measured when the fixing device 431 is manufactured is stored in the memory 708.

Figure 9:
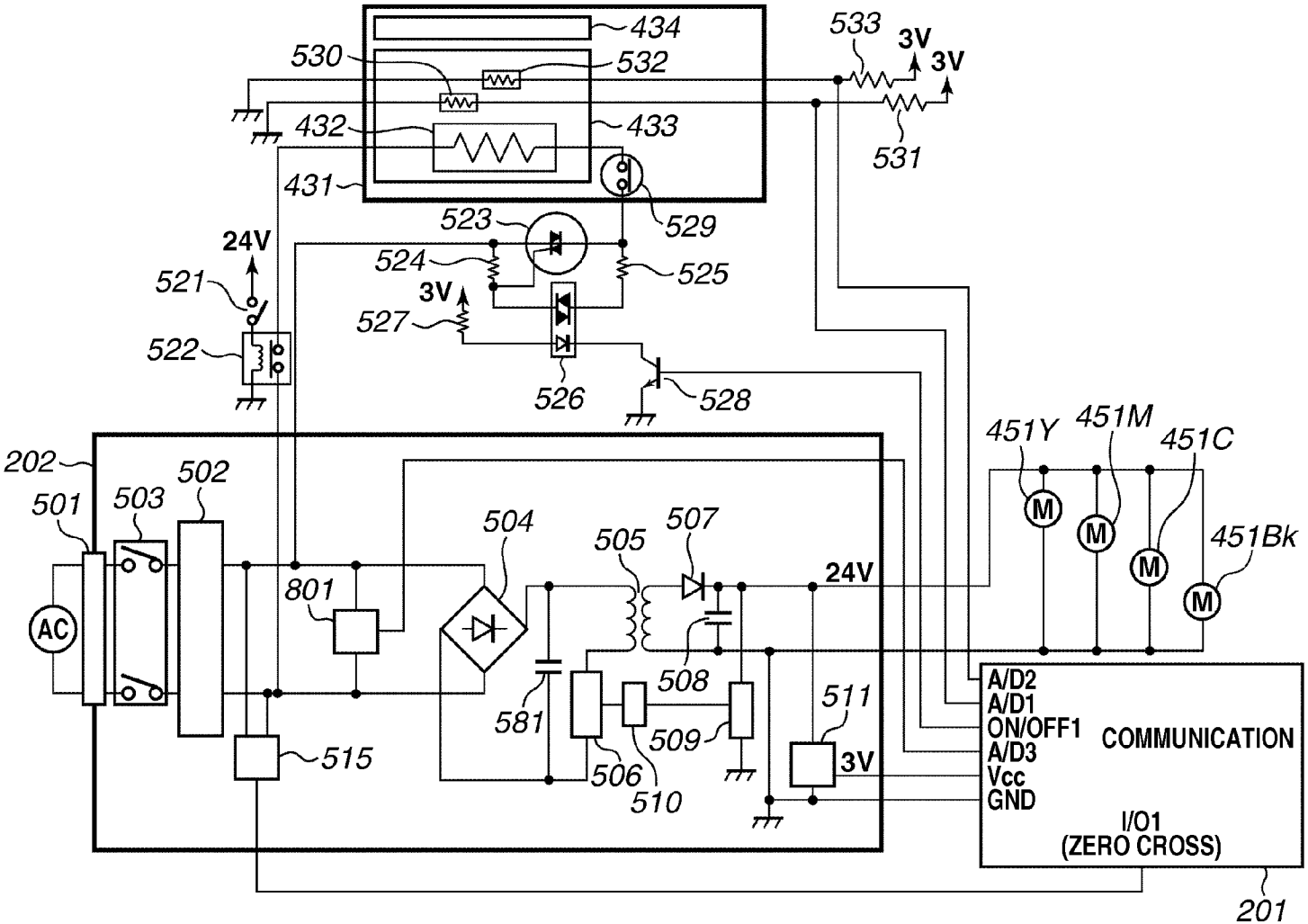
FIG. 9 is a block diagram illustrating details of a low voltage power source and details of a power control circuit of a fixing device according to the second exemplary embodiment.

FIG. 9 is a block diagram illustrating details of the low voltage power source circuit 202 and details of the power control circuit of the fixing device 431 in the exemplary embodiment. An input voltage detection circuit 801 (power source condition detection unit) primarily and secondarily converts the detected input voltage to output the converted input voltage to the A/D port 3 of the printer controller 201. Since the configuration and an operation of the fixing device 431 other than the heater current detection operation are similar to those in FIG. 3, the same reference numerals are given thereto and the description thereof will be omitted.

Next, an image forming operation will be described. First, the image data is transmitted from the host computer 441 to the video controller 440. The video controller 440 transmits, to the printer controller 201, a print signal which instructs the printer controller 201 to start the formation of an image and converts the received image data into bitmap data. Upon receiving the print signal, the printer controller 201 supplies power to the fixing device 431 and starts driving the scanner motor 423, the main motor 451, the ITB motor 707, and the motor 453 of the fixing device at a predetermined timing. Further, the printer controller 201 drives the pickup roller 404, the sheet feeding roller 405, and the retard roller 406 to pick out the recording material 32 from the sheet feeding cassette 402. The recording material 32 is conveyed to the registration roller pair 407 and then temporarily suspended. Thereafter, the printer controller 201 transmits an image data transmission starting signal (hereinafter, referred to as a TOP signal) to the video controller 440 at a predetermined timing.

Upon receiving the TOP signal, the video controller 440 transmits the bitmap data to the printer controller 201. Upon receiving the bitmap data, the printer controller 201 controls the laser unit 421 to be turned on/off according to the bitmap data and forms an electrostatic image on the photosensitive drum 305 charged at a predetermined potential by the charging roller 303 via the polygon mirror 422 and the image forming lens group 424. Thereafter, the electrostatic image is developed into a toner image by the development roller 302 and the toner image on the photosensitive drum 305 is transferred onto the ITB 701 by the transfer roller 430. Such an image forming operation is performed for yellow Y, magenta M, cyan C, and black Bk to form a color toner image on the ITB 701. Subsequently, the printer controller 201 re-feeds the recording material 32 from the registration roller pair 407 according to the color toner image formed on the ITB 701 and transfers the color toner image on the ITB 701 to the recording material 32 by the secondary transfer roller 704 to which a voltage having a predetermined potential has been applied. The color toner image formed on the recording material 32 is conveyed to the fixing device 431 and heated and pressed by the heating sleeve 433 heated at a predetermined temperature and the pressure roller 434, to be fixed on the recording material 32. Then, the recording material 32 is discharged by the fixing discharge roller pair 435 to the outside of the image forming apparatus 401.

Figure 10:
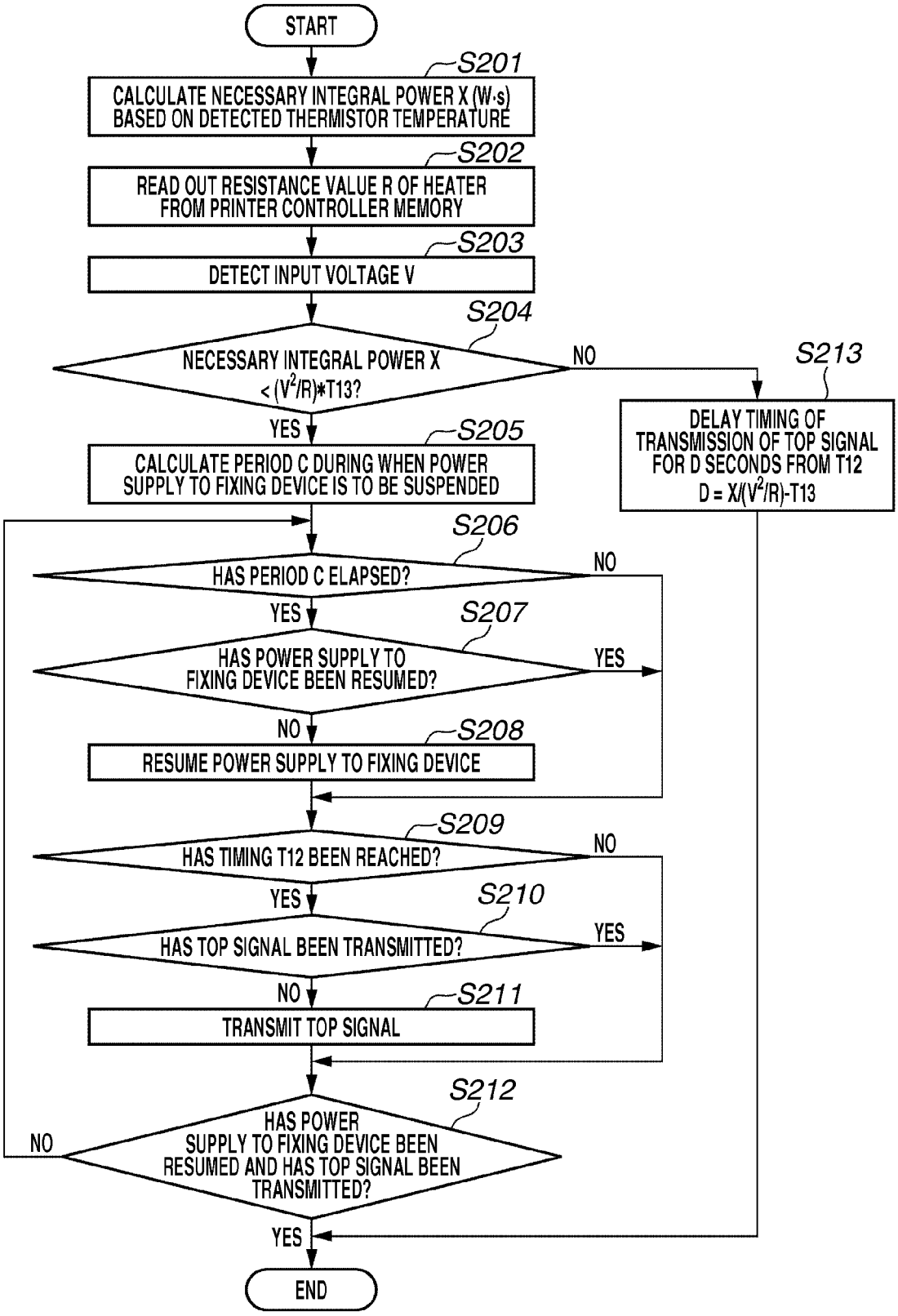
FIG. 10 is a flowchart illustrating an operation of supplying power to the fixing device according to the second exemplary embodiment.

Next, an operation performed until the printer controller 201 transmits the TOP signal to the video controller 440 after starting formation of the image will be described in detail with reference to FIGS. 10 and 11. FIG. 10 is a flowchart illustrating the operation of supplying power to the fixing device 431 according to the exemplary embodiment, and FIG. 11 is a view illustrating a temperature change of the thermistor 532.

Figure 11:
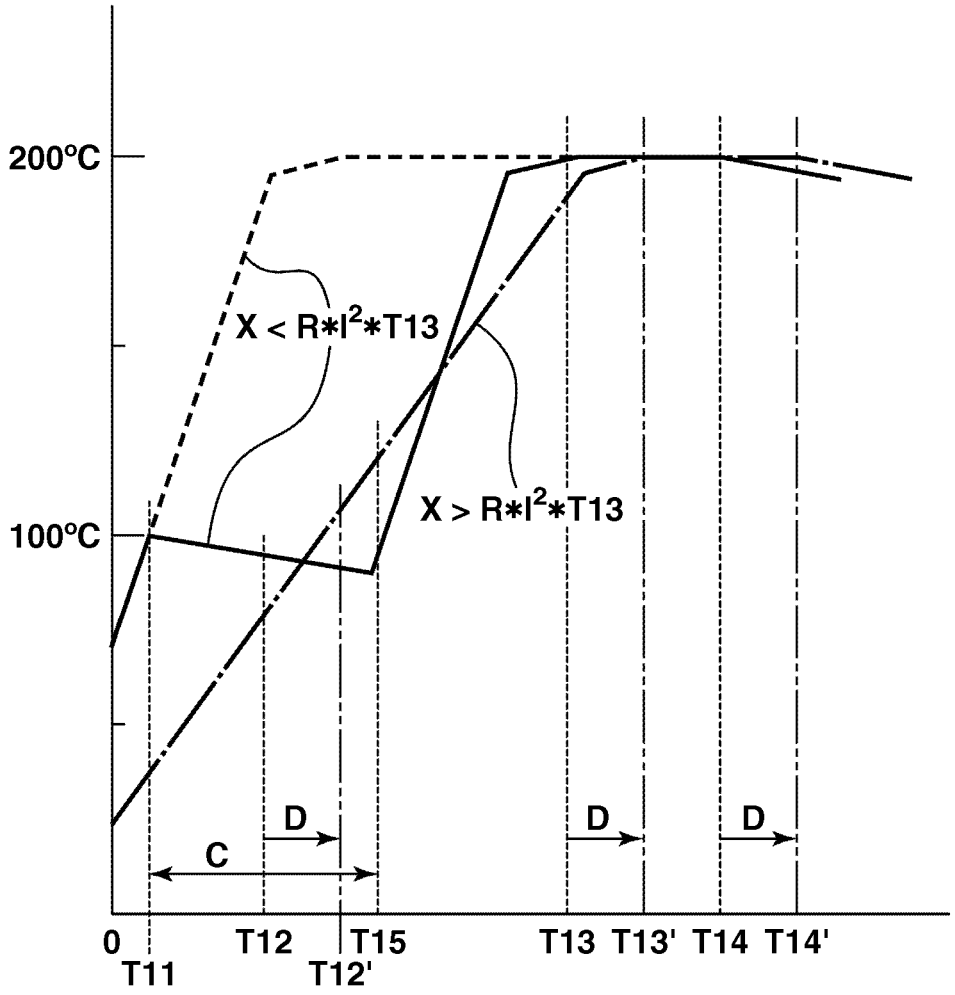
FIG. 11 is a view illustrating a temperature change of a thermistor according to the second exemplary embodiment.

Referring to FIG. 11, a time 0 to a time T11 is a period during which the input voltage V is detected, a time T12 is a transmission timing of the TOP signal, a time T13 is a timing when the recording material reaches the fixing device 431, and a time T14 is a timing when the recording material is discharged from the image forming apparatus. Times T12', T13', and T14' are timings respectively delayed from T12, T13, and T14 for D seconds when the TOP signal transmission timing is delayed for D seconds. Further, a time T15 is a timing when the power supply to the fixing device 431 is resumed.

As illustrated in FIG. 10, when image formation is started, then in step S201, the microcomputer 207 on the printer controller 201 detects the temperature of the thermistor 532 and calculates a necessary integral power X required for the fixing device 431 to reach 200° C., which is a control target temperature, from the table in FIG. 7 stored in the microcomputer 207. Next, in step S202, a resistance value of the heater 432 is read out from the printer controller memory 708. Next, in step S203, an average input voltage V for a period to the time T11 is detected. Next, in step S204, equation (3) is calculated to determine whether the fixing device (heater) reaches the control target temperature of 200° C. by the time T13 when the recording material reaches the fixing device.

$$\text{Necessary integral power } X(W{\cdot}s) < (V^2/R) * T13 \quad (3)$$

The right side of equation (3) is the suppliable integral power that can be supplied to the heater for a period from the time 0 to the time T13. If the necessary integral power X(W·s) is smaller than the suppliable integral power (YES in step S204), then in step S205, the printer controller 201 calculates a period C(s) during which the power supply to the fixing device is suspended. The suspension period C satisfies the relationship indicated by equation (4) and is calculated from equation (5). Further, Y indicates a supplied power W per second which is additionally required according to the lowering of the temperature of the fixing device 431 during a power supply suspension period.

$$T13-(X+Y*\text{suspension period } C)/(V^2/R)=\text{Suspension period } C \quad (4)$$

$$\text{Suspension period } C=((V^2/R)*T13)/((V^2/R)+Y)-X/((V^2/R)+Y) \quad (5)$$

Next, in step S206, it is determined whether the suspension period C(s) has elapsed. If the suspension period C(s) has elapsed (YES in step S206), then in step S207, it is determined whether the power supply to the fixing device 431 has been resumed. If the power supply has not been resumed (NO in step S207), then in step S208, the power supply is resumed. If the suspension period C(s) has not elapsed (NO in step S206) or if the power supply to the fixing device 431 has been resumed (YES in step S207), the operation proceeds to step S209. In step S209, it is determined whether the TOP signal transmission timing T12 has been reached. If it is determined to reach T12 (YES in step S209), then in step S210, it is determined whether the TOP signal has been transmitted. If the TOP signal has not been transmitted (NO in step S210), then in step S211, the printer controller 201 transmits the TOP signal to the video controller 440. If it is not determined to reach T12 in step S209 (NO in step S209) or if the TOP signal has been transmitted in step S210 (YES in step S210), the operation proceeds to step S212. In step S212, it is determined whether the power supply to the fixing device 431 has been resumed and the TOP signal has been transmitted. If at least one of the operations has not been completed (NO in step S212), the operation returns to step S206 to repeat the above processes until both of the operations are completed. The time T12 (timing T12) is a shortest timing to transmit the TOP signal. By performing the above operations, the temperature of the fixing device 431 can reach the fixing temperature at a timing when the recording material enters the fixing device 431 (as illustrated by solid line in FIG. 11), and a power consumption can be reduced as compared with a case where the above operation is not performed (as illustrated by dotted line in FIG. 11).

In the meantime, in step S204, if the integral power X(W·s) is larger than the suppliable integral power (NO in step S204) and if the TOP signal is transmitted at the timing T12, the toner image is insufficiently fixed since the fixing temperature does not reach 200° C. when the recording material 32 reaches the fixing device 431. Therefore, in step S213, equation (6) is calculated to delay the timing of transmission of the TOP signal for D seconds from T12.

$$\text{Re-feeding delay time } D=X/(V^2/R)-T13 \quad (6)$$

As a result, when the recording material 32 reaches the fixing device 431, the temperature of the fixing device has reached 200° C. (as illustrated by T13' in FIG. 11).

As described above, according to the exemplary embodiment, a similar effect to the first exemplary embodiment is obtained. Further, power can be reduced in a case where the fixing device reaches the fixing temperature before the recording material 32 reaches the fixing device 431, i.e., in a case where the fixing device 431 is heated in advance or the input voltage is high.

Further, in the exemplary embodiment, if the necessary integral power X(W·s) is smaller than the suppliable integral power, a period during which power supply to the fixing device 431 is suspended is provided to reduce the power. However, a method of reducing the power is not limited thereto. For example, control may be performed such that, by reducing the power supplied to the fixing device 431, the temperature is gradually increased, and the fixing device reaches the fixing temperature at a timing when the recording material reaches the fixing device 431.

In the first and second exemplary embodiments, the necessary integral power required for the thermistor to detect 200° C., which is the fixing temperature, is calculated using a constant relational expression. However, the necessary integral power changes according to an ambient environmental temperature of the image forming apparatus. In a third exemplary embodiment of the present invention, a control method for correcting the necessary integral power which is required to reach 200° C. depending on the ambient environmental temperature of the image forming apparatus will be described. Since the configuration of the image forming apparatus, the fixing device 431, and the circuit and the image forming operation are similar to those of the first exemplary embodiment, the description thereof will be omitted.

Figure 12:
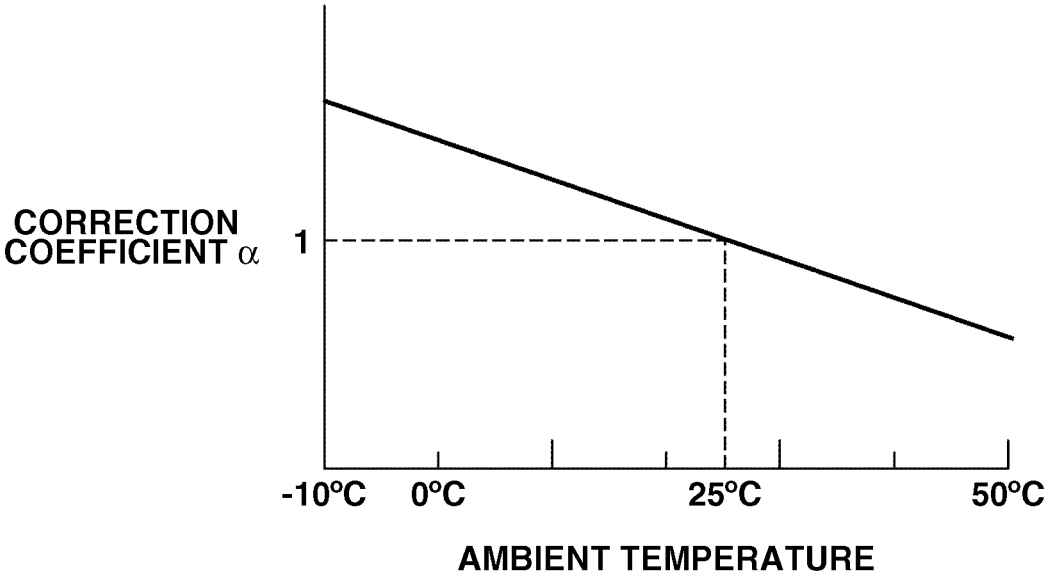
FIG. 12 is a table for correcting, with an ambient temperature, a necessary integral power required until a fixing device reaches 200° C. according to a third exemplary embodiment of the present invention.

FIG. 12 is a table illustrating a relationship between the ambient environmental temperature of the image forming apparatus and a correction value α of the necessary integral power, the table being stored in the microcomputer 207 on the printer controller 201.

Figure 13:
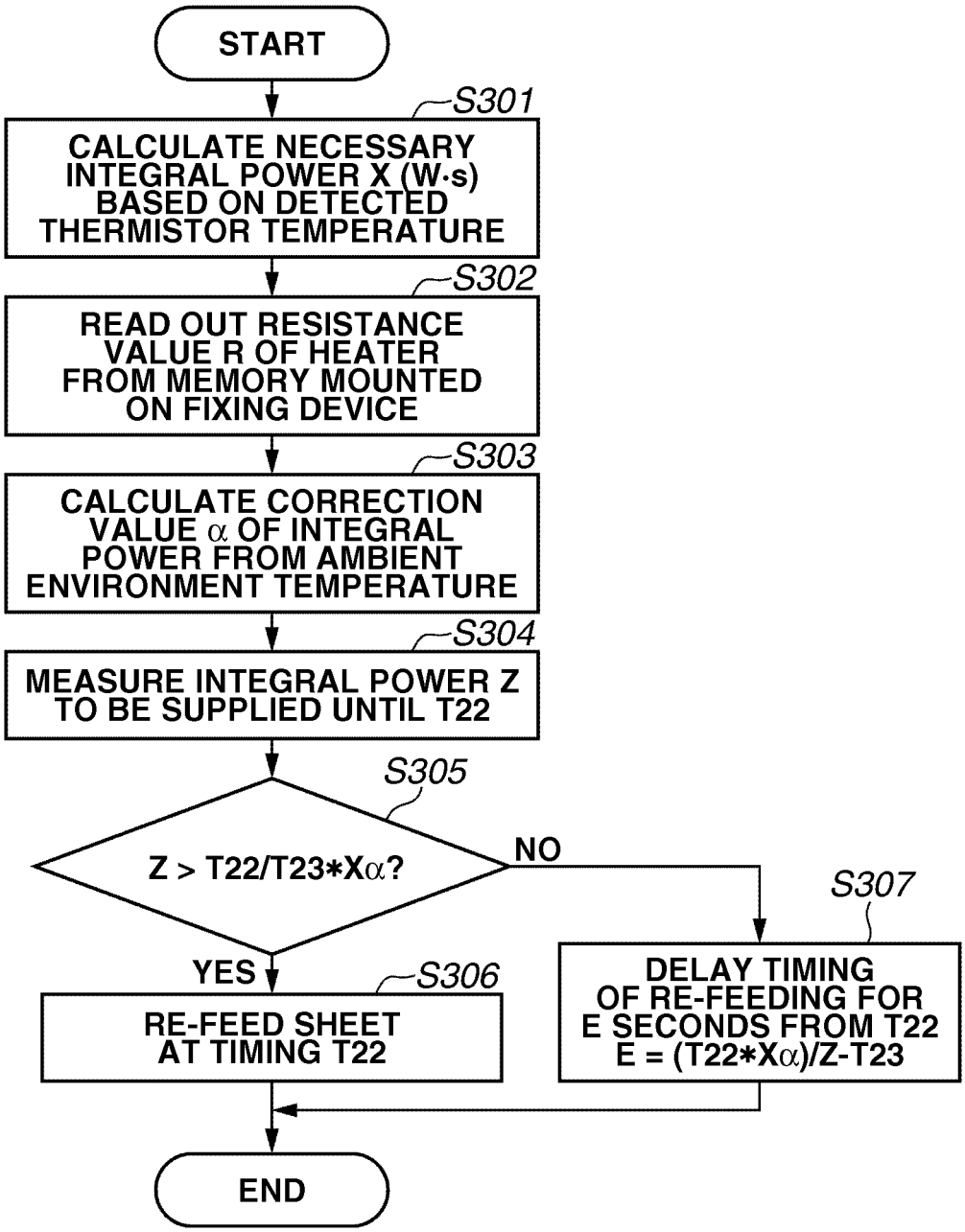
FIG. 13 is a flowchart illustrating an operation of supplying power to the fixing device and a timing of re-feeding according to the third exemplary embodiment.

Next, an operation performed until the printer controller 201 re-feeds the recording material, which has been temporarily suspended on the registration roller pair 407, after starting formation of the image will be described in detail with reference to FIGS. 13 and 14. FIG. 13 is a flowchart illustrating the operation of supplying power to the fixing device 431 and a timing of re-feeding, and FIG. 14 is a view illustrating a temperature change of the thermistor 532.

Figure 14:
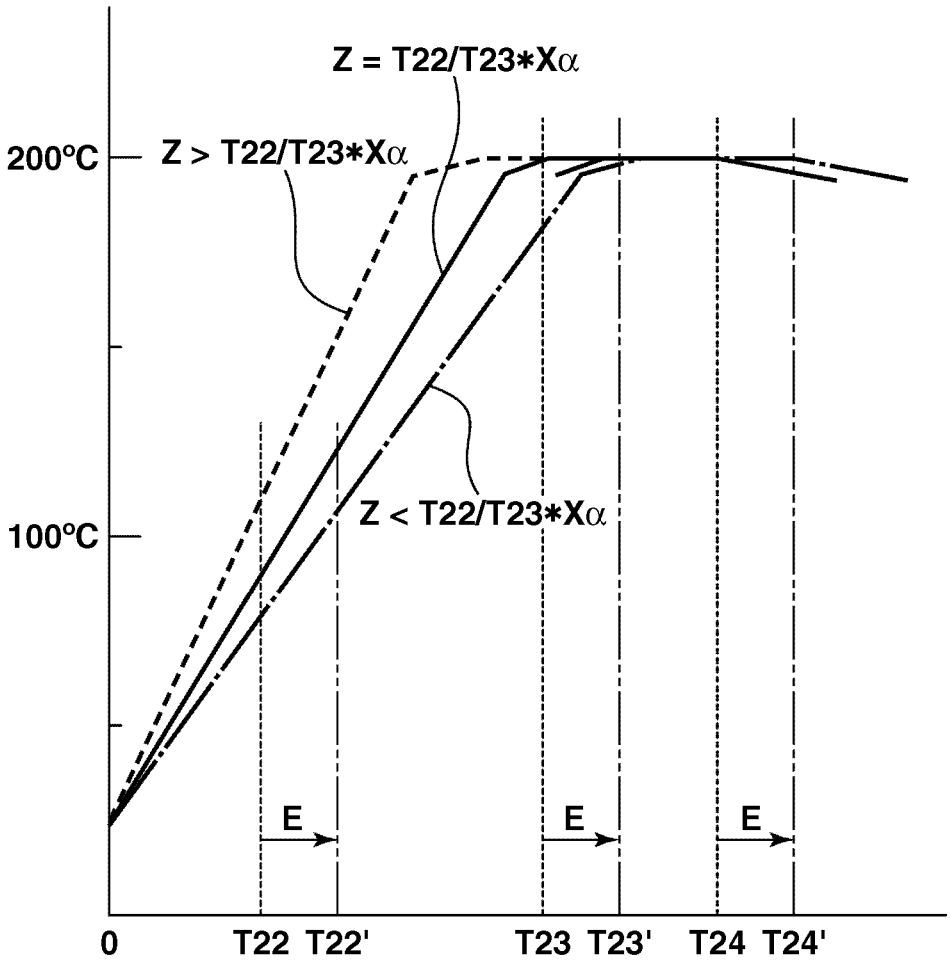
FIG. 14 is a view illustrating a temperature change of a thermistor according to the third exemplary embodiment.

In FIG. 14, a time T22 is a timing when the recording material, which has been temporarily suspended on the registration roller pair 407, is re-fed, a time T23 is a timing when the recording material reaches the fixing device 431, and a time T24 is a timing when the recording material is discharged from the image forming apparatus. Times T22', T23', and T24' are timings respectively delayed from T22, T23, and T24 for E seconds when the timing of re-feeding is delayed for E seconds.

Referring to FIG. 13, when the image formation is started, then in step S301, the microcomputer 207 on the printer controller 201 first calculates the necessary integral power X which is required for the fixing device 431 to reach, from a temperature of the thermistor 532, 200° C., which is the fixing temperature. Subsequently, in step S302, a resistance value R of the heater 432 is read out from the memory 323 mounted on the fixing device. Next, in step S303, an integral power correction value α is calculated from an ambient temperature of the image forming apparatus, which is detected by a temperature detection sensor 324, and the table illustrated in FIG. 12 to correct the necessary integral power X. The corrected necessary integral power is considered as Xα.

Next, in step S304, an integral supplied power Z to the time T22 is calculated from a resistance value R of the heater 432 and a heater current I using equation (7).

$$\text{Integral supplied power } z=\int_0^{T22} I(t)^2 * R dt \quad (7)$$

Next, in step S305, equation (8) is calculated to determine whether the heater reaches the fixing temperature of 200° C. by the time T23 when the recording material reaches the fixing device.

$$\text{Integral supplied power } Z>T22/T23*X\alpha \quad (8)$$

When the integral supplied power Z is larger (YES in step S305), in step S306, the printer controller 201 re-feeds the recording material at the timing T22 and starts the formation of an image on the photosensitive drum 305. The time T22 (timing T22) is a shortest timing to re-feed the recording material 32. In the meantime, if the integral supplied power Z is smaller (NO in step S305) and if the recording material 32 is re-fed at the timing T22, the toner image is insufficiently fixed since the fixing temperature does not reach 200° C. when the recording material 32 reaches the fixing device 431. Therefore, in step S307, equation (9) is calculated to delay the timing of re-feeding for E seconds from T22.

$$\text{Re-feeding delay time } E=(T22*X\alpha)/X-T23 \quad (9)$$

As a result, when the recording material 32 reaches the fixing device 431, the fixing temperature has reached 200° C. (as illustrated by T23' in FIG. 14).

As described above, according to the exemplary embodiment, even when the ambient environmental temperature of the image forming apparatus is changed, the FPOT can be shortened to the minimum.

The first to third exemplary embodiments have been described using a ceramic heater which has one resistance heat generator on the ceramic substrate. However, the number of resistance heat generators is not limited to one. In the case of a ceramic heater which includes a plurality of resistance heat generators, by storing a resistance value of each of the resistance heat generators for each fixing device, and using a combined resistance value of the resistance heat generators supplied with power at the time to start image formation, the similar effect may be obtained. Further, the exemplary embodiments may be applicable to an image forming apparatus in which a fixing device using a heater other than the ceramic heater as a heater is mounted.

Further, the first to third exemplary embodiments have been described using the inline-type color image forming apparatus. However, the similar effect may be obtained in a monochromic image forming apparatus or a four-path-type image forming apparatus.

According to the exemplary embodiments of the present invention, the timing of sheet feeding can be determined earlier and thus the FPOT can be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-124837 filed May 31, 2012, which is hereby incorporated by reference herein in its entirety.

What is claimed is:

1. An image forming apparatus, comprising:

an image forming unit configured to form an unfixed toner image on a recording material;

a fixing unit configured to heat and fix the unfixed toner image onto the recording material, the fixing unit including a heater;

a necessary integral power calculation unit configured to calculate a necessary integral power required for the fixing unit to reach a predetermined fixable temperature;

a suppliable integral power calculation unit configured to calculate a suppliable integral power being supplied to the heater in a time elapsing until the recording material reaches the fixing unit;

a power source condition detection unit configured to detect a power source condition of a power source for supplying power to the heater; and a controller configured to control a timing to start conveyance of the recording material by comparing the necessary integral power and the suppliable integral power, wherein the suppliable integral power calculation unit calculates the suppliable integral power according to a resistance value of the heater, the power source condition, and the time elapsing until the recording material reaches the fixing unit.

2. The image forming apparatus according to claim 1, wherein the necessary integral power calculation unit calculates the necessary integral power based on a temperature of the fixing unit at a timing when the power supply to the heater is started.

3. The image forming apparatus according to claim 1, wherein the controller sets a timing to start conveyance of the recording material to be later when the suppliable integral power is smaller than the necessary integral power than when the suppliable integral power is larger than the necessary integral power.

4. The image forming apparatus according to claim 2, wherein the necessary integral power calculation unit corrects the necessary integral power according to an ambient environment of the image forming apparatus.

5. The image forming apparatus according to claim 1, wherein the power source condition detection unit is a current detection unit for detecting a current flowing in the heater.

6. The image forming apparatus according to claim 1, wherein the power source condition detection unit is a voltage detection unit for detecting a voltage applied to the heater.

7. The image forming apparatus according to claim 1, further comprising:

a storage unit configured to store the resistance value of the heater.

8. The image forming apparatus according to claim 7, wherein the storage unit is mounted on the fixing unit.

9. The image forming apparatus according to claim 1, wherein the fixing unit includes an endless belt configured to be heated by the heater.

10. The image forming apparatus according to claim 9, wherein the heater is in contact with an inner surface of the endless belt.

11. The image forming apparatus according to claim 10, wherein the fixing unit further includes a roller for forming a nip portion which nips and conveys the recording material together with the heater via the endless belt therebetween.

12. An image forming apparatus, comprising:

an image forming unit configured to form an unfixed toner image on a recording material;

a fixing unit configured to heat and fix the unfixed toner image onto the recording material, the fixing unit including a heater;

a first power calculation unit configured to calculate a necessary integral power required for the fixing unit to reach a predetermined fixable temperature, the first power calculation unit calculating the necessary integral power based on a temperature of the fixing unit at a timing when a power supply to the heater is started;

a second power calculation unit configured to acquire a suppliable power being supplied to the heater per unit time, the second power calculation unit calculating the suppliable power based on a current flowing to the heater or a voltage to be applied to the heater and a resistance value of the heater;

a controller configured to control a timing to start conveyance of the recording material, wherein the controller controls the timing to start conveyance of the recording material by comparing the necessary integral power and a suppliable integral power which is a multiplication value of the suppliable power and a necessary time until the recording material reaches the fixing unit.

13. The image forming apparatus according to claim 12, wherein the controller sets the timing to start conveyance of the recording material to a predetermined timing when the suppliable integral power is larger than the necessary integral power.

14. The image forming apparatus according to claim 13, wherein the controller sets the timing to start conveyance of the recording material to a timing later than the predetermined timing when the suppliable integral power is smaller than the necessary integral power.

15. The image forming apparatus according to claim 12, further comprising:

a storage unit configured to store the resistance value of the heater, wherein the storage unit is mounted on the fixing unit.

16. The image forming apparatus according to claim 12, wherein the first power calculation unit corrects the necessary integral power according to an ambient environment of the image forming apparatus.

17. The image forming apparatus according to claim 12, wherein the fixing unit includes an endless belt configured to be heated by the heater.

18. The image forming apparatus according to claim 17, wherein the heater is in contact with an inner surface of the endless belt.

19. The image forming apparatus according to claim 18, wherein the fixing unit further includes a roller for forming a nip portion which nips and conveys the recording material together with the heater via the endless belt therebetween.

* * * * *